United States Patent [19]

Schrencongost

[11] 4,278,001

[45] Jul. 14, 1981

[54] SELECTIVE KEYER BIASING TO ENHANCE PERCUSSION EFFECT

[75] Inventor: Ray B. Schrencongost, Park Ridge, Ill.

[73] Assignee: Marmon Company, Chicago, Ill.

[21] Appl. No.: 106,725

[22] Filed: Dec. 26, 1979

[51] Int. Cl.[3] ..... G10H 1/055; G10H 1/057; G10H 5/07

[52] U.S. Cl. ..... 84/1.26; 84/1.13; 84/1.19; 84/1.23

[58] Field of Search ..... 84/1.11, 1.13, 1.19, 84/1.22, 1.23, 1.26

[56] References Cited

U.S. PATENT DOCUMENTS

| | | | |
|---|---|---|---|
| 3,636,231 | 1/1972 | Schrecongost et al. | 84/1.23 |
| 3,637,915 | 1/1972 | Hirano | 84/1.13 |
| 3,746,775 | 7/1973 | Uchiyama | 84/1.26 |
| 3,784,718 | 1/1974 | Uchiyama | 84/1.13 |
| 3,819,844 | 6/1974 | Isii | 84/1.26 |
| 3,848,142 | 11/1974 | Adachi | 84/1.13 X |
| 3,861,263 | 1/1975 | Okudaira | 84/1.11 |
| 4,185,532 | 1/1980 | Hiyoshi et al. | 84/1.26 |
| 4,201,106 | 5/1980 | Kimura et al. | 84/1.26 X |
| 4,205,581 | 6/1980 | Robinson | 84/1.26 |
| 4,205,582 | 6/1980 | Howell et al. | 84/1.26 |

*Primary Examiner*—S. J. Witkowski

*Attorney, Agent, or Firm*—Neuman, Williams, Anderson & Olson

[57] ABSTRACT

A keying system provides selectable decay times for individual components of a tone to be generated by an electronic organ having a top octave generator producing a multiplicity of rectangular wave signals, and a plurality of associated divider circuits. The keying system comprises a keyer block having a plurality of identical keying sections. Each keying section comprises at least two MOSFET transistors which are connected in series and the series combination is connected between a supply voltage and a load resistor. A multiple position switch is connected to each load resistor to selectively connect the load resistor to one of a plurality of biasing voltage supplies. Rectangular wave signals from the top octave generator and divider circuits are applied to the gate of one of the transistors in each of the identical keying sections of the keyer block. Upon the depression of a key on a playing keyboard, a keyer envelope signal is applied to the gates of the other transistors in each of the identical keying sections of a keyer block. Upon receipt of the rectangular wave signal and the envelope signal the keying section provides an output signal which is a rectangular wave form that is modulated to varying degrees by the keyer envelope signal, the degree of modulation depending on the biasing voltage applied through the multiple position switch to the individual load resistor. The modulated rectangular wave output signals from the individual keying sections are passed through filters and combined by output circuitry to form the desired tones.

18 Claims, 3 Drawing Figures

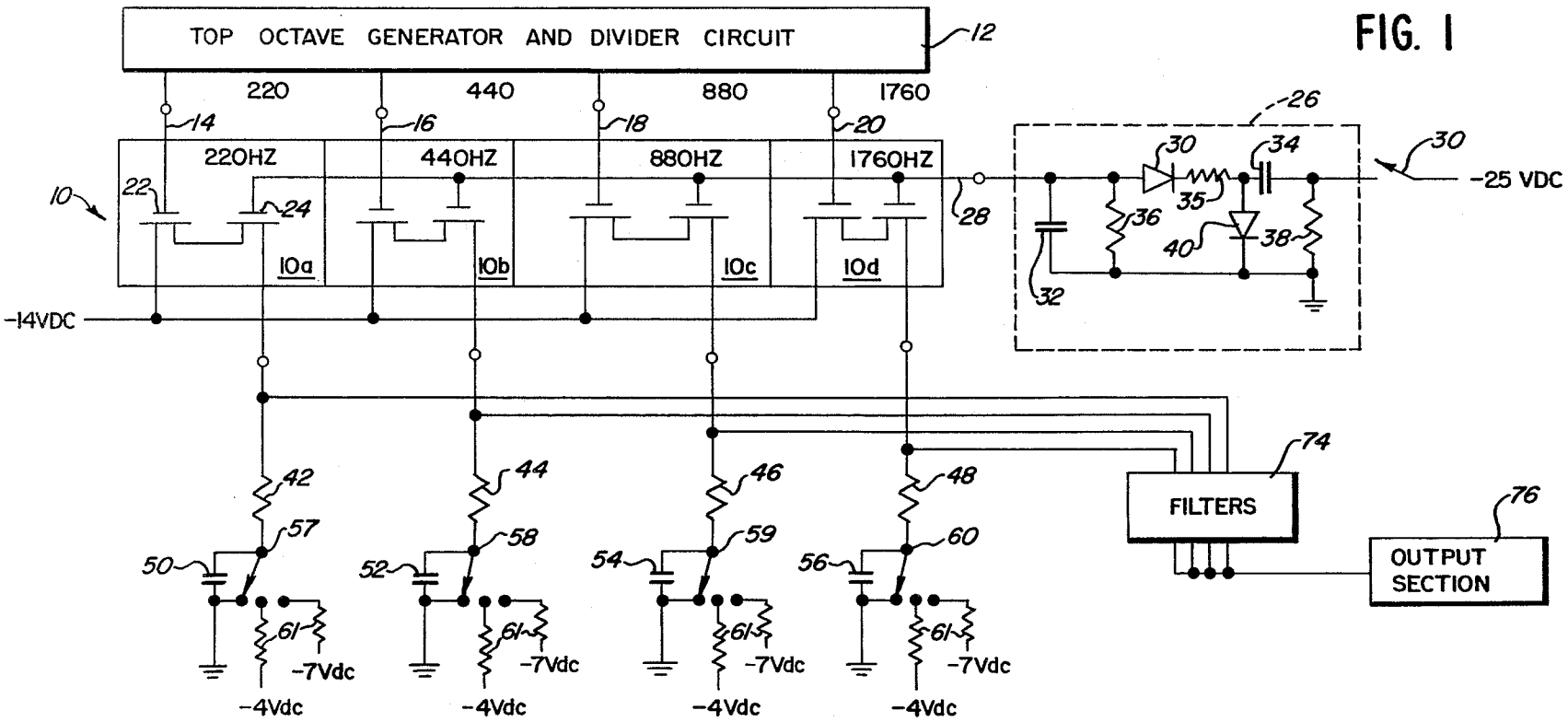
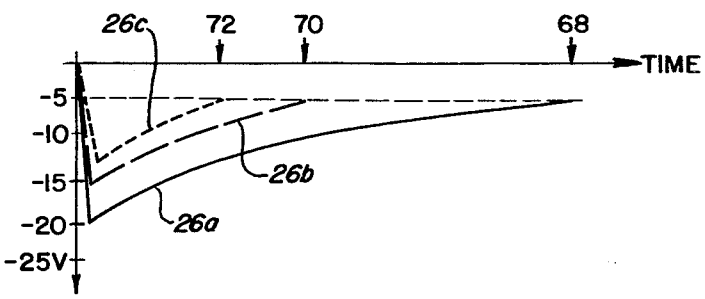
FIG. 2
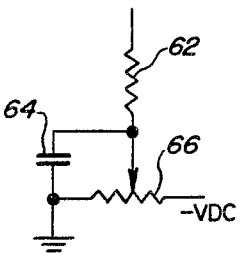
FIG. 3

SELECTIVE KEYER BIASING TO ENHANCE PERCUSSION EFFECT

BACKGROUND OF THE INVENTION

This invention is directed to keyer circuits for use in electronic organs and more particularly to a keyer circuit for enhancing percussion tones generated on electronic synthesis and formant organs.

The synthesis electronic organ is based upon the knowledge that sustained, complex musical tones can be synthesized by mixing properly scaled sine waves having frequencies representative of the fundamental and the various harmonics of the tone to be synthesized. This can be accomplished by having each organ playing key operate a group of contacts to connect the output signals from various harmonic generators to corresponding harmonic buses which are combined to form a synthesized tone. This is referred to as alternating current (AC) keying.

The formant electronic organ uses as starting signals so-called "bright waves" or signals which are rich in harmonic content including a fundamental frequency and a full complement of harmonics. Formant filter circuits which resonate or otherwise discriminate on a frequency basis are then used to remove unwanted harmonics and alter the harmonic balance of these complex signals to arrive at desirable tone signals. The formant system does not have the choice of tone coloration available with the synthesis approach, however, since it is not necessary to key the multiplicity of signals representative of the fundamental and various harmonics separately, fewer contacts are required in an AC keying system.

AC keying provides great control of tone quality since the level of the fundamental and each harmonic waveform is independently selected as desired. However, the multiple contacts of AC keying systems tend to make the playing key action too stiff for some people. Also, the multiple contacts needed in AC keying systems must be of high quality, since the tone components are switched at low signal levels. These high quality multiple contacts are quite expensive. In the standard type synthesis organ 61 sets of these expensive multiple contact switches are necessary which adds considerably to the overall cost of the organ. Furthermore, even high quality multiple contact switches are prone to failure at one or more contact points due to normal wear, dust and alignment problems and these failures result in the production of a distorted or harmonically incomplete tone signal.

The disadvantages of AC keying lead to the development of direct current (DC) keying wherein a DC signal controls a switching device which passes the AC signals while the device is activated. DC keying allows the use of a single contact per playing key and is utilized in both formant and synthesis organs.

An improved electronic organ DC keyer system is disclosed in U.S. Pat. No. 3,636,231 which provides the benefits of AC keying for synthesis organs but requires only one contact per playing key. Each keyer circuit comprises a plurality of keyer sections with one keyer section for the fundamental frequency and additional keyer sections for each of the desired harmonics of the fundamental frequency which make up the musical note or tone which is to be synthesized by the organ. By depressing the playing key and thereby closing the single contact the associated keyer circuit is operated.

Each keyer section comprises two transistors connected in series. Rectangular wave signals corresponding to the frequency of the fundamental and its harmonics are produced by a top octave generator and a series of dividers. One of the transistors of each keyer section is controlled by a selected one of these rectangular wave signals. A keyer input signal generated by the depression of each playing key controls all of the other transistors of the keyer circuit. Each keyer section produces a modulated rectangular wave signal output which is filtered to obtain an output signal which is substantially a modulated sine wave. Finally, the output signals from the keyer sections of a keyer circuit for a selected note are combined and passed to an output section to synthesize that note.

Of course, the DC keyer circuit of the above-identified patent can also be used in a formant organ. For use in a formant organ, bright waves are applied as tone input signals to the individual keyer sections. The keyer sections are similarly driven by a keyer envelope signal resulting in modulated bright wave output signals which are passed to formant filter circuits. The output signals from the formant filters are passed to an output section to sound the desired tones.

In keyer circuits for both synthesis and formant organs it is advantageous to provide an arrangement for controlling the tone envelope, i.e., the rate of attack and decay of the tone signal, to avoid transients which introduce "thumps" and other objectionable noise and also to achieve various desirable special effects. To achieve this purpose the keying signal from the playing key to a keyer circuit has a defined envelope, i.e., the rate of attack and decay of the keyer input signal is controlled.

Prior art arrangements provide only a single keying envelope signal to a given keyer circuit which controls the attack and decay time for the keyer input signal controlling the fundamental and harmonics or the bright wave signals. If a different tone signal is desired, it is known to change the keyer envelope signal; however, still only one envelope signal is applied to a keyer circuit at a time. For example, a keying envelope signal with a fast rise and slow decay time might be provided to the keyer circuit to generate a percussion tone. Although such envelope changes improve the tones generated, truly realistic tone production would require multiple keying signals with differing envelopes to be applied simultaneously to the same keyer circuit to independently control the attack and decay times for the fundamental and the harmonic components or the bright wave signals. Existing keyer circuits cannot be operated by multiple keying signals and, in any event, the use of such multiple keying signals would produce difficult timing and circuit design problems.

More particularly, many tones have components which have differing decay times, e.g., percussion tones wherein the initial strike components die away rapidly and the accompanying lower frequency components die away gradually over a substantially longer period of time. Such tones cannot be accurately synthesized by existing keyer circuits which receive a single keyer envelope signal.

SUMMARY OF THE INVENTION

The present invention overcomes these shortcomings of the prior art by providing more accurate production of tones having components with differing decay times, such as percussion tones, while retaining the advantageous single keyer envelope signal. The individual keyer sections of a DC keyer circuit are selectively biased to provide independent decay times for the individual signals which are used to generate the tone for that keyer circuit. The selective biasing effectively provides individual keyer envelope signals for each of the keyer sections of the keyer circuits.

The present invention is a keying system for selecting the decay times of individual components of a tone to be produced by an electronic organ which utilizes a multiplicity of rectangular wave tone signals which are produced by a top octave generator and divider circuit. The keying system comprises a keying block having a plurality of identical keying sections. Each keying section comprises two semiconductor elements, such as transistors, connected in series with the series combination being connected between a supply voltage source and a load resistor. Means are provided for selecting and applying one of at least two voltage levels to one or more of the load resistors so that the decay time of the individual keying section output signal is independently controlled. Rectangular wave signals from the top octave generator and divider circuit are applied to the inputs of one of the transistors in each of the identical keying sections of the keyer block. Upon depression of a playing key by the instrument player, a keyer envelope signal is applied to the other transistor of all of the keying sections. The output signals of the keying sections are rectangular waves for a synthesis organ and bright waves for a formant organ which are modulated to varying degrees by the keyer envelope signal, the degree of modulation depending on the voltage levels applied to the individual load resistors. The modulated signals are passed through filters and combined by output circuitry to form the desired tones. This keyer system structure controls the decay times of the individual components which make up a tone to be generated by an electronic organ to effectively provide each keying section with an individual keyer envelope signal.

Advantageously, a keyer system in accordance with the present invention provides more realistic tone production, for example percussion tones are generated to have short-lived strike components and longer-lived lower frequency components. Furthermore, the keyer system provides a variable decay time for one or more of the individual frequency components or bright waves which make up a tone while permitting the continued use of a single keyer envelope signal per keyer circuit.

BRIEF DESCRIPTION OF THE DRAWING

The invention will be better understood from the following detailed description of the preferred embodiment when read with reference to the drawing in which:

FIG. 1 is a schematic diagram of a keyer circuit in accordance with the present invention;

FIG. 2 is a graph of a keyer envelope signal; and

FIG. 3 is a schematic diagram of a continuously variable source of biasing potential which can alternately be used in the keyer circuit of FIG. 1.

DESCRIPTION OF THE PREFERRED EMBODIMENT

It is to be understood that the keyer circuit of the present invention is equally applicable to a synthesis organ, a formant or "bright wave" organ or any other electronic instruments to which the invention can be reasonably adapted. Referring to FIG. 1, a single keying block is indicated at 10 and is organized to provide the keying functions for all the signals called upon to supply tones for a particular organ playing key. The keying block for the A 440 hertz note having its fundamental frequency at 440 hertz is the only keying block shown since other keying blocks are identical but with different connections as will be evident.

A top octave generator and divider circuit 12 provides rectangular wave signals for the organ including the signals necessary to generate the A note. A 220 hertz signal is connected to a conductor 14 and 440 hertz, 880 hertz and 1760 hertz signals are connected respectively to conductors 16, 18 and 20.

These signals supply rectangular waves having fundamental components at the frequencies designated and accompanied by a declining series of harmonic components as is characteristic of rectangular wave signals. These signals also supply, where appropriate, the inputs to other keyer blocks for other playing keys. For example, the 440 hertz signal supplies the fundamental tone to the block shown. It also supplies the second harmonic for the A key which is an octave lower, the fourth harmonic for the A key which is two octaves lower, and so on. This general arrangement of multiple use of signals is well known in electronic organs. It is to be noted that the keyer circuit of the illustrative embodiment includes only four keyer sections for ease of description. However, the present invention is equally applicable to keyer circuits having any number of keyer sections such as the keyer circuit in U.S. Pat. No. 3,636,231 which includes nine keyer sections per keyer circuit.

The keying block 10 is of the MOSFET (Metal Oxide Silicon Field Effect Transistor) integrated circuit type, with all the active elements formed on a single chip of material. These transistors are well known in the art and have the characteristics that conduction between the drain, or input, and the source, or output, depends upon the potential at the gate, or control, relative to the source. The more negative the gate beyond a threshhold level, the greater the conduction for a "P"-type enhancement MOSFET.

The left-most keyer section **10*a* is representative of the other keyer sections 10*b*, 10*c* and 10*d*. Each keyer section includes two MOSFET transistors indicated in 10*a* as 22 and 24. The drain of the input transistor 22 of each keyer section is connected to a source of negative DC potential, such as −14 VDC as shown. The gate of each of the input transistors 22 is connected to its respective rectangular wave signal generated by the top octave generator and divider circuit 12 and the source of each input transistor 22 is connected to the drain of each output transistor 24. The gates of each of the output transistors 24 of all of the keyer sections are connected internally on the MOSFET chip and in turn connected to the percussion keyer circuit 26 via the conductor 28**.

A negative DC potential, such as −25 volts as shown, is connected to the percussion keyer circuit 26 through normally open contacts 30 which are a part of the organ playing key for the A-playing key having its fundamental at 440 hertz. When the playing key is depressed, these contacts close and when the key is released, they separate. The continuous application of the negative 25 volt DC potential to the percussion keyer circuit 26 causes it to generate the percussion keyer envelope shown by the solid wave form **26*a* in FIG. 2**.

Although the present invention is particularly attractive for use with a percussion keyer circuit, it is to be understood that the invention is equally applicable to controlling the attack and decay times of keyer circuits other than percussion keyer circuits.

Whenever the A-playing key is depressed and held down to close the contacts 30, the voltage on the conductor 28 does rapidly to about negative 20 volts. This is due to the voltage division between capacitor 32 and capacitor 34. The capacitor 32 has approximately one-fifth the capacitance of the capacitor 34 and serves to prevent an abrupt voltage transition of the keying envelope signal. After the initial division of voltage between the capacitor 32 and the capacitor 34, the capacitor 34 charges through resistor 35, resistor 36 and diode 30. The time constant established primarily by the capacitor 34 and the resistor 36 define the wave form 26*a* of the keying envelope shown by the solid line in FIG. 2. When the A-playing key is released to open the contacts 30, the capacitor 32 discharges through the resistor 36 and the capacitor 34 discharges through a resistor 38 and a diode 40. The diodes 30 and 40 allow different charge and discharge rates for the capacitor 34 and protect the MOSFET keyer block 10.

The sources of the output transistors 24 of the keyer sections 10*a* through 10*d* are individually connected to load resistors 42 through 48. Each of the load resistors is also connected to the common terminal of multiple connection switches 57 through 60. Three position switches are shown in FIG. 1; however, switches having two or more positions could be utilized in the invention. Each of the load resistors is connected to ground through capacitors 50, 52, 54 and 56 which together with the resistors 61 serve to suppress switching noises generated by operation of the organ. A continuously variable biasing potential can also be applied to each of the load resistors via a voltage control device, such as a rheostat as shown in FIG. 3 where a load resistor 62 is connected to ground through a capacitor 64 and receives a continuously variable voltage between ground and a negative supply voltage −VDC from the rheostat 66.

Each of the load resistors 42, 44, 46 and 48 shown in FIG. 1 can be alternately connected to ground, negative 4 volts DC or negative 7 volts DC through the switches 57 through 60. The switching of the bias voltages applied to the load resistors of the keyer circuit effectively provides an individual keyer envelope signal to each of the keyer sections even though only one keyer envelope signal is applied to each keyer circuit.

The effect of controlling the bias voltage to the load resistors is most easily seen in FIG. 2. As previously noted, the conduction of the output transistors 24 depends upon the potential at the gate relative to the source. Accordingly, selectively biasing the load resistors for the output transistors 24 determines the portion of the keyer envelope wave form 26*a* shown in FIG. 2 which is sufficiently negative to place the output transistors 24 into their conductive state. This portion is determined by the threshold level of the device plus the additional bias voltage applied to the load resistor. For example, if the load resistor is connected to ground and the threshold of the output transistor is approximately negative 5 volts DC, then the entire envelope signal shown by the wave form 26*a* in FIG. 2 to the point in time 68 will activate that output transistor and provide a relatively long decay time for that particular tone component.

If negative 4 volts DC is selected as the load biasing potential for a keyer section, then the lower section of the envelope signal below approximately negative 9 volts will serve to activate the output transistor and that transistor will be conductive to the point in time 70. It should be observed that a negative 4 volts DC bias is the equivalent of having a keyer envelope signal as indicated by the dashed line wave form 26*b* in FIG. 2 applied to the gate of the associated output transistor. If a negative 7 volts DC is selected as the biasing potential for a keyer section, then the output transistor of that keyer section is active for the lower section of the keyer envelope signal below a voltage equal to approximately negative 12 volts DC and the transistor will conduct to the point in time 72. It should be observed that a negative 7 volts DC bias is the equivalent of having a keyer envelope signal as indicated by the dotted line wave form 26*c* in FIG. 2 applied to the associated output transistor.

Accordingly, variable decay times can be selected for each of the components which make up a given note or tone. The illustrative system shown in FIG. 1 allows the independent selection of three different decay times for each keyer section. The modified biasing arrangement indicated in FIG. 3 allows an essentially unlimited number of decay time variations between the maximum time indicated as 68 in FIG. 2 and the elimination of the component. Of course, all keying sections may not require selective biasing so that one or more of the switches 57 through 60 and their associated circuitry can be eliminated and their load resistors connected directly to ground. Also, the switches 57 through 60 can be operated individually or ganged together to provide various desirable effects as is well known in the electronic organ art.

The outputs of the individual keyer sections as modulated by the keyer input envelope signal under the influence of the selectable biases applied to the load resistors 42, 44, 46 and 48 are applied to the filters 74 and ultimately to the output section 76 to generate the enhanced percussion tones.

From the above description, it is apparent that the present invention allows the generation of notes or tones which include individual components having varying decay times while utilizing a single keyer envelope signal. While only certain embodiments and alternatives thereof have been set forth, other alternative embodiments and various modifications will be apparent to those skilled in the art and are considered equivalents and within the spirit and scope of the present invention.

What is claimed is:

1. A keying system for use in an electronic organ having a top octave generator and divider circuit for providing a plurality of rectangular wave signals at various frequencies and a keyboard for providing a keying signal upon depression of any key, said keying system comprising:

a keying block having a plurality of identical keying sections, each of said keying sections having at least a first and a second semiconductor switching device, all of said semiconductor devices having an input, a control and an output;

a direct current supply having a first potential source and a reference potential, said first potential source being connected to the input of the first semiconductor device of each of said sections;

first conductor means for connecting the output of the first semiconductor device of each section to the input of the second semiconductor device of the same section;

a plurality of load resistors connected individually between the outputs of said second of said semiconductor devices and said reference potential;

circuit means inserted between at least one of said load resistors and said reference potential for controlling the level of potential applied to said at least one of said load resistors;

second conductor means for connecting the rectangular wave signals generated by said top octave generator and divider circuit individually to the controls of one of the semiconductor devices of each section; and envelope means having a source of keying potential for applying an envelope signal to the controls of the other of said semiconductor devices of each of said sections upon depression of a key on said keyboard whereby the effect of the envelope signal provided to at least one of said keying sections is selectable.

2. The keying system in accordance with claim 1 wherein said circuit means comprises at least a second potential source relative to said reference potential and at least one switch for connecting said at least one load resistor to said second potential source and to said reference potential.

3. The keying system in accordance with claim 1 further comprising means for generating at least a second potential source relative to said reference potential and wherein said circuit means comprises at least one switch for connecting said at least one load resistor to said second potential source and to said reference potential.

4. The keying system in accordance with claim 1 wherein said circuit means comprises a source of biasing potential and at least one variable voltage selector connected to said biasing potential and to said at least one of said load resistors.

5. The keying system in accordance with claim 1 wherein said circuit means comprises a source of scaled potentials and at least one slidable contact for connecting said at least one of said load resistors to any scaled potential available from said source of scaled potentials.

6. The keying system in accordance with claim 1, 2, 3, 4 or 5 wherein said semiconductor switching devices comprise field effect transistors and said control comprises a gate.

7. An electronic organ having a top octave generator and divider circuit for providing a plurality of rectangular wave signals at various frequencies, a keyboard for providing a keying signal upon depression of any key and a keyer system receiving selected ones of said rectangular wave signals and said keying signal and providing a tone signal output, said keyer system comprising:

a keying block having a plurality of identical keying sections, each of said keying sections having at least a first and a second semiconductor switching element, all of said semiconductor switching elements having an input, a control and an output;

a direct current supply connected to the input of the first semiconductor element of each of said sections;

first conductor means for connecting the output of the first semiconductor element of each section to the input of the second semiconductor element of the same section;

a plurality of load resistors connected individually to the outputs of said second of said semiconductor elements;

circuit means connected to said load resistors for individually controlling the voltage levels applied to said load resistors;

second conductor means for connecting selected ones of said rectangular wave signals generated by said top octave generator and divider circuit individually to the controls of one of the semiconductor elements of each section;

and envelope means having a source of keying potential for applying an envelope signal to the controls of the other of said semiconductor elements of said sections upon depression of a key on said keyboard.

8. The electronic organ of claim 7 further comprising:

a group of filters connected individually to the outputs of said second of said semiconductor elements for summing and filtering the signals from said second semiconductor elements; and a common output circuit connected to receive the output signals from said filters and to generate a tone in response thereto.

9. The electronic organ of claim 7 wherein said circuit means comprises two or more sources of potential at different potential levels and a plurality of switches for individually connecting said resistors to any one of said sources of potential.

10. The electronic organ of claim 7 wherein said circuit means comprises a source of biasing potential and a plurality of continuously variable voltage selectors connected to said biasing potential and to said resistors.

11. The electronic organ of claim 7 further comprising means for generating two or more potential levels and wherein said circuit means comprises a plurality of switches for individually connecting said resistors to any one of said sources of potential.

12. The electronic organ of claim 7 wherein said circuit means comprises a source of scaled potential and a plurality of slidable contacts for individually connecting said resistors to any scaled potential available from said source of scaled potential.

13. An electronic organ having a top octave generator and divider circuit for providing a plurality of rectangular wave signals at various frequencies, a keyboard for providing a keying signal upon depression of any key and a keyer system receiving selected ones of said rectangular wave signals and said keying signal and providing a tone signal output, said keyer system comprising:

a keying block having a plurality of identical keying sections, each of said keying sections having at least a first and a second semiconductor switching element, all of said semiconductor elements having an input, a control and an output;

a direct current supply connected to the input of the first semiconductor element of each of said sections;

first conductor means for connecting the output of the first semiconductor element of each section to the input of the second semiconductor element of the same section;

a plurality of load resistors connected individually to the outputs of said second of said semiconductor elements;

control means connected to said plurality of load resistors for individually controlling the attack time and decay time for the individual tone components generated by each of said keyer sections;

second conductor means for connecting selected ones of said rectangular wave signals from said top octave generator and divider circuit individually to the controls of one of the semiconductor elements of each of said keyer sections; and envelope means including a source of keying potential for applying an envelope signal to the controls of the other semiconductor elements of said keyer sections in response to said keying signal.

14. The electronic organ of claim 13 wherein said control means comprises biasing means for selectively biasing the plurality of load resistors at one of two or more potential levels.

15. The electronic organ of claim 14 wherein said biasing means comprises a source of reference potential and at least one source of potential relative to said reference potential and a plurality of switches for individually connecting said load resistors to said reference potential and to said at least one source of potential.

16. The electronic organ of claim 14 wherein said biasing means comprises a source of biasing potential and a plurality of continuously variable voltage selectors connected to said biasing potential and to said resistors.

17. The electronic organ of claim 14 wherein said biasing means comprises a source of scaled potential and a plurality of slidable contacts for individually connecting said resistors to any scaled potential available from said source of scaled potential.

18. The electronic organ of claim 7, 8, 9, 10, 11, 12, 13, 14, 15, 16 or 17 wherein said semiconductor switching elements comprise field effect transistors and said control comprises a gate.

* * * * *